US006554916B2

(12) United States Patent
Kojima et al.

(10) Patent No.: US 6,554,916 B2
(45) Date of Patent: Apr. 29, 2003

(54) TREATMENT METHOD FOR MAKING HEAT EXCHANGER HYDROPHILIC AND HEAT EXCHANGER TREATED TO BE HYDROPHILIC

(75) Inventors: Masahiro Kojima, Tochigi (JP); Takashi Sudo, Tochigi (JP); Shintaro Nakagawa, Tochigi (JP); Masahiko Matsukawa, Tokyo (JP); Toshio Inbe, Kanagawa (JP); Tatsuo Yoshida, Tokyo (JP)

(73) Assignees: Nippon Paint Co., Ltd., Osaka (JP); Showa Denko K.K., Tokyo (JP)

( * ) Notice: Subject to any disclaimer, the term of this patent is extended or adjusted under 35 U.S.C. 154(b) by 0 days.

(21) Appl. No.: 09/854,147

(22) Filed: May 12, 2001

(65) Prior Publication Data

US 2002/0040742 A1 Apr. 11, 2002

(30) Foreign Application Priority Data

May 12, 2000 (JP) ..... 2000-140957
Apr. 27, 2001 (JP) ..... 2001-131365

(51) Int. Cl.[7] ..... C23C 22/57

(52) U.S. Cl. ..... 148/275; 148/247; 148/251; 148/254; 148/265; 427/189; 427/221; 428/469; 428/472.2

(58) Field of Search ..... 148/247, 251, 148/254, 265, 275; 427/189, 221; 428/469, 472.2

(56) References Cited

U.S. PATENT DOCUMENTS 5,750,258 A * 5/1998 Sakai et al. ..... 427/221

FOREIGN PATENT DOCUMENTS

| | | | |
|---|---|---|---|
| EP | 0180908 | | 5/1986 |
| EP | 0676250 | | 10/1995 |
| EP | 0911427 | | 4/1999 |
| JP | 11-209622 A | * | 8/1999 |
| WO | WO 9638238 | | 12/1996 |

OTHER PUBLICATIONS

Database WPI, Section Ch, Week 198849, Derwent Publications Ltd., London, GB; AN 1988–350349, XP002175729 & JP 63 262238 A (Sky Aluminium Co Ltd), Oct. 28, 1988, *abstract*.

Patent Abstract, JP 06228459, Aug. 16, 1994.

Patent Abstract, JP 06300482, Oct. 28, 1994.

* cited by examiner

*Primary Examiner*—John Sheehan
*Assistant Examiner*—Andrew L. Oltman

(57) ABSTRACT

A treatment method for hydrophilicity for a heat exchanger which can maintain the deodorizing property and hydrohilicity even after a long-time use, and a heat exchanger thus treated for hydrophilicity by said method are provided. After a previous acidic washing treatment, a heat exchanger is subjected to a chemical transformation treatment to form a chemical conversion coating film using a chromium chromate treatment agent, chromium phosphate treatment agent, or treatment agent of zirconium series, followed by a treatment for hydrophilicity using a treatment agent for hydrophilicity, which contains silica particulates and polymer of vinyl alcohol series in aqueous medium in a weight ratio 30:70~70:30 and in tot al content of 1~25 weight percent, and in which said silica particulates are coated with said polymer of vinyl alcohol series, and dispersed as coated particles of the average particle diameter of 5~1000 nm in aqueous medium, to form the coating film so as to amount to 1~3 g/m$^2$.

36 Claims, No Drawings

TREATMENT METHOD FOR MAKING HEAT EXCHANGER HYDROPHILIC AND HEAT EXCHANGER TREATED TO BE HYDROPHILIC

BACKGROUND OF THE INVENTION

1. Field of the Invention

The present invention relates to a treatment for making a heat exchanger, especially, a car evaporator which is used in air conditioners such as those for vehicles, hydrophilic, more specifically, a treatment method for making a heat exchanger with an excellent lasting hydrophilicity, deodorizing capability and corrosion resistance hydrophilic, and a heat exchanger treated to be hydrophilic by said method (hydrophilic heat exchanger).

2. Background Art

In general, heat exchangers are constructed of aluminum, and complex in structure having aluminum fins for the heat exchange held between pipes within narrow spaces. Therefore, it has been devised so as to facilitate the discharge of condensed water during the cooling operation by making the surface of aluminum fins, etc. hydrophilic. However, since the surface of aluminum fins, etc, which has been made hydrophilic as described above, is exposed to severe conditions including the repeated cycle of "heating←→cooling", and adhesion of condensed water, atmospheric dusts or microorganisms, there have been problems that it is difficult to maintain the hydrophilicity of the surface of heat exchanger for a long period.

A variety of inventions have been made to solve these problems, and, for example, in Japanese Patent Laid-open Publication No. Hei 5-202313, a treatment agent for hydrophilicity comprising a mixture of polyvinyl alcohol and water-dispersible silica or a complex thereof, and lithium metasilicate has been disclosed. Herein, lithium metasilicate is said to be effective in maintaining the lasting hydrophilicity, lowering the freezing temperature and expressing antimicrobial activity.

In addition, in Japanese Patent Laid-open Publication No. Hei 5-214273, a paint composition consisting of a water-soluble or water-dispersible organic resin, nitrogen-containing anticorrosive and silica particulates, and coated aluminum materials with coating film obtained from this paint composition have been disclosed.

Furthermore, in Japanese Patent Publication No. 2649297, a paint composition for fin materials made of aluminum or aluminum alloy containing water-soluble or water-dispersible organic resin (excluding water-soluble amino resins), water-soluble amino resin, water-dispersed agglutinating colloidal silica containing silanol groups of 50 mμ~2 mμ in particle size, or water-dispersible humed silica powder, and a surfactant with HLB value of 8~18, fin materials and a method for manufacturing these fin materials have been disclosed. This invention aims at obtaining a pre-coated type fin material and a hydrophilic coating resistant to drawless processing (ironing) during the manufacturing of heat exchanger.

In addition, in Japanese Patent Laid-open Publication No. Hei 10-30069, an aqueous agent to give hydrophilicity containing colloidal silica of 5~100 nm in dispersed particle size and carboxylic acid polymer at pH 1~5, and a method for manufacturing pre-coated fin materials for the heat exchanger using this agent have been disclosed.

All of these aforementioned prior arts have aimed to enhance the hydrophylicity of paint compositions utilizing irregularities of silica surface by using water-soluble or water-dispersible resin together with colloidal silica or particulate silica. However, hydrophilic coatings formed by the combined use of resin and particulate silica tend to deteriorate due to the long time use of heat exchanger. As a result, particulate silica is exposed, posing problems such as emission of silica specific dust smell or stink from materials adsorbed on silica.

Furthermore, fins, etc. of heat exchanger are often assembled (constructed) by brazing using solders such as aluminum-silicon alloy, aluminum-silicon-magnesium alloy, etc. However, deposits from solders adhering to the surface of fins, etc. during brazing often lead to difficulties in rust preventive treatment such as chemical transformation, posing problems such as the decrease in the corrosion resistance of heat exchanger and formation of white rust. Furthermore, there have been other problems that molds growing in water adsorbed to white rust are strewn inside buildings and automobiles by the ventilator fan, generating stink.

The aforementioned problems maybe solved if deposits from solders can be cleaned off by the pretreatment such as washing, it was difficult however to sufficiently clean away said deposits by the conventional washing with acid, alkali or surfactant. For example, in Japanese Patent Laid-open Publication No. Hei 11-131254, a method for treating the surface of aluminum-containing metal materials has been disclosed, wherein the chemical etching treatment of metal materials is performed, prior to the treatment to make the surface hydrophilic, using an acidic aqueous solution containing at least one acid selected from a group consisting of sulfuric acid, hydrofluoric acid, nitric acid and phosphoric acid, and then the chemical transformation technique was applied to the etched surface with the aqueous solution of ziruconium (Zr) phosphate or titanium (Ti) phosphate. However, the aforementioned prior art was not sufficiently effective in removing said deposits, and aluminum-containing metal materials subjected to the treatment to make them hydrophilic still had a tendency to develop white rust in a prolonged salt water spraying test.

In view of the aforementioned problems, the present invention has been made, aiming to provide a treatment method for making a heat exchanger hydrophilic, which is superb in the lasting hydrophilicity, deodorizing capability and corrosion resistance, and a heat exchanger thus treated for making it hydrophilic (hydrophilic heat exchanger).

SUMMARY OF THE INVENTION

To achieve the aforementioned purposes, a treatment method of this invention for making the metal surface hydrophilic aims to sufficiently clean off deposits of solders by devising a pickling agent for the cleaning process performed prior to the chemical transformation treatment, facilitating the subsequent chemical transformation treatment. With such a treatment method, it has become possible for the first time to improve the corrosion resistance of heat exchanger and at the same time prevent the stink emission caused by white rust.

In addition, a treatment method for hydrophilicity of this invention is to enhance the lasting hydrophilicity and deodorizing capability of the heat exchanger by using a treatment for making the metal surface hydrophilic comprising silica particulates coated with polymer of vinyl alcohol series dispersed in aqueous medium.

Specifically, this invention provides the following cleaners and cleaning methods.

(1) A pickling method for a heat exchanger made of aluminum materials, wherein a cleaning treatment is performed by bringing said heat exchanger into contact with a pickling agent containing at least one acid selected from a group comprising nitric acid, sulfuric acid and hydrofluoric acid prior to the chemical transformation treatment applied to said heat exchanger.

As the example of a pickling agent used in this invention, there are aqueous solutions comprising nitric acid, sulfuric acid or hydrofluoric acid, or combinations thereof, and further supplemented with iron salts. The acid concentration of these cleaners is preferably 1~10 N, more preferably 3~5 N.

(2) The pickling method according to the aforementioned (1), wherein said pickling agent contains an iron salt.

(3) The pickling method according to the aforementioned (2), wherein said iron salt is iron sulfate, iron nitrate, iron acetate or iron chloride.

(4) The pickling method according to the aforementioned (2) or (3), wherein said pickling agent contains an iron salt in the range 0.01~5 weight percent.

Said pickling agents preferably contain iron salts such as iron sulfate, iron nitrate, iron acetate, iron chloride, etc. Said iron salts are contained favorably at 0.01~5 weight percent in an acidic aqueous solution, more preferably made to contain at 0.1~1 weight percent. It is advantageous that iron salts contained in the aforementioned concentration range contribute to a more effective acidic washing off of deposits caused by solders. Pickling agents containing iron salts can be preferably used in the case of the formation of chemical conversion coating film of zirconium series with a slightly inferior corrosion resistance in particular.

(5) The pickling method according to the aforementioned (4), wherein said cleaning treatment comprises bringing said heat exchanger into contact with said pickling agent under the conditions at 10~70° C. for 30 s~5 min.

Conditions for cleaning treatment are preferably at 10~85° C. for the liquid temperature of cleaners and for 30 s~5 min as the contact time. When the liquid temperature is lower than 10° C. or the contact time is less than 30 s, removal of deposits, etc. may become insufficient, and when the temperature exceeds 85° C., or the contact time is longer than 5 min, etching (cleaning treatment) may become excessive.

(6) The pickling method according to any of the aforementioned (1)~(5), wherein said heat exchanger has brazed parts.

(7) The pickling method according to any of the aforementioned (1)~(6), wherein said heat exchanger is a car evaporator.

A pickling method according to this invention can be preferably used for heat exchangers such as car evaporator having brazed portions to assemble fins and pipes by soldering. This is because a pickling method of this invention enables the sufficient cleaning of deposits derived from solders to facilitate the chemical transformation treatment, contributing to the improvement of corrosion resistance of heat exchanger and prevention of stinks caused by white rust.

(8) A treatment method for making a heat exchanger hydrophilic comprising previously performing the pickling treatment for a heat exchanger by any of methods according to the aforementioned (1)~(5), and performing a chemical transformation treatment to form a chemical conversion coating film by the chromium chromate treatment agent or chromium phosphate treatment agent, followed by the treatment for making the heat exchanger hydrophilic using the following treatment agent for hydrophilicity, so that the amount of coating film becomes 0.1~3 g/m$^2$.

"Treatment agent for hydrophilicity" means a treatment agent which contains silica particulates and polymers of vinyl alcohol series in the weight ratio of 30:70~70:30 in aqueous medium, amounting to 0.2~25 weight percent in total for both, in which said silica particulates are coated with said polymer of vinyl alcohol series, and dispersed in the aqueous medium as coated particles having the average particle diameter 5~1000 nm.

(9) A treatment method for making a heat exchanger hydrophilic comprising previously performing the pickling treatment for a heat exchanger by any of methods according to the aforementioned (2)~(5), and performing a chemical transformation treatment to form a chemical conversion coating film by a zirconium series treatment, followed by the treatment for making said heat exchanger hydrophilic using the following treatment agent for hydrophilicity, so that the amount of coating film becomes 0.1~3 g/m$^2$.

"Treatment agent for hydrophilicity" means a treatment agent which contains silica particulates and polymers of vinyl alcohol series in the weight ratio in the range 30:70~70:30 in aqueous medium, amounting to 0.2~25 weight percent in total for both, in which said silica particulates are coated with said polymer of vinyl alcohol series, and dispersed in the aqueous medium as coated particles having the average particle diameter 5~1000 nm.

As the chemical transformation treatment agent, the conventionally known chromium chromate treatment, chromate phosphate treatment, or non-chromium zirconium series treatment can be used.

The chromium chromate treatment agent is an aqueous solution containing chromic acid, fluoride and strong acid, including the reaction type chromate and electrolyte type chromate with the trivalent chromium as the principal ingredient, and a spreading type chromate in which hexavalent and trivalent chromium are mixed. On the other hand, the chromate phosphate treatment agent is a mixed aqueous solution containing chromic acid, orthophosphate and fluoride. For the chemical transformation treatment carried out with these chromate treatments, it is required to control each of the amounts of hexavalent chromium, phosphate ion and fluoride ion.

An example of the non-chromium ziruconium series treatment agent can be exemplified by ziruconium salts including zirconium fluoride. Furthermore, it is also preferred to add acids such as phosphoric acid, manganic acid, permanganic acid, vanadic acid, tungstic acid, molybdic acid, etc. to these salts. In addition, in the case of the use of non-chromium zirconium series treatment agents, it is essential to perform the washing treatment with pickling agent containing iron salts.

By performing the chemical transformation treatment with the above-described chemical transformation agent, chemical transformation film such as chromate coating film, chromium phosphate coating film, or zirconium series coating film containing no chromium are formed on the surface of heat exchanger.

A treatment agent for making the heat exchanger hydrophilic used in this invention comprising silica particulates coated with a polymer of vinyl alcohol series dispersed in aqueous medium is morphologically different from the mixture of silica particulates and resin particles, or silica particulates bound to resin with a silane compound in the conventional arts.

Silica particulates usable as the raw material of treatment agents to make a heat exchanger hydrophilic according to this invention can be exemplified by humed silica and colloidal silica. Among them, humed silica is prepared by hydrolyzing halosilane such as trichlorosilane and tetrachlorosilane at high temperature in the vapor phase, which is particulate having large surface area. Colloidal silica is a silica sol of the acid- or alkali-stable type dispersed in water. Particle diameter of silica particulates is 5~100 nm, preferably 7~60 nm on the average. When this average particle diameter is less than 5 nm, the irregularity of treated coating film is not sufficient, resulting in the decrease in hydrophilicity, and when it exceeds 100 nm, aggregates of large particle diameter are formed in the preparation of treatment agents, aggravating the painting processability.

A typical polymer of vinyl alcohol series usable in this invention is polyvinyl alcohol (PVA) obtained by saponifying a vinyl acetate polymer. PVA with a high saponification level is preferred, especially the one with a saponification level exceeding 98% is preferred. Denatured PVAs, for example, PVAs denatured with a carboxylic acid, silicon, amine and thiol can be also used as the polymer of vinyl alcohol series according to this invention. Furthermore, as the occasion demands, other hydrophilic polymers such as hydroxyl group-containing acrylic resins, polyacrylic acid, polyvinyl sulfonic acid, polyvinylimidazole, polyethylene oxide, polyamide, water-soluble nylon, etc. can be used together with PVA in amount of less than 50 weight percent relative to PVA.

Total content of silica particulates and polymer of vinyl alcohol series is 0.2~25 weight percent, preferably 1~5 weight percent Weight ratio of silica particulates to polymer of vinyl alcohol series is in the range 30:70~70:30, preferably 40:60~60:40.

When the aforementioned total content of vinyl alcohol polymer and silica particulate is less than 0.2 weight percent, effects of lasting hydrophylicity and deodorizer are not expressed, and, on the other hand, when said total content exceeds 25 weight percent, viscosity of the treatment agent becomes high, aggravating the painting processability. When the weight ratio of silica particulates to polymer of vinyl alcohol series is out of the range 30:70~70:30, with a higher ratio of silica particulates, the coating film formation becomes insufficient, resulting in the exfoliation of the film to emit dust smell from silica and base material, and with a higher ratio of polymer of vinyl alcohol series, hydrophilicity is reduced.

Amount of coating film formed by the treatment for making the metal surface hydrophilic is set up to be 0.1~3 $g/m^2$, preferably 0.2~1 $g/m^2$. When the coating film amount is less than 0.1 $g/m^2$, the hydrophilic property is not expressed, and, on the other hand, when it exceeds 3 $g/m^2$, the productivity is reduced.

(10) The treatment method for making a heat exchanger hydrophilic according to the aforementioned (8) or (9), wherein said treatment agent for hydrophylicity contains a deodorizer comprising an organic material having amido and/or phenol groups.

And, the deodorizer usable in this invention can be exemplified by organic compounds containing amido group and/or phenol group such as water-soluble polyamides, flavonoids, aqueous phenols, hydrazine derivatives (for example, carbodihydrazides, hydrazine adipate, hydrazine sebatate, hydrazine didodecate, hydrazine isophthalate, 1,6-hexamethylenebis(N,N'-dimethylsemicarbazide), 1,1,1',1'-tetramethyl-4,4'(methylene-di-p-phenylene)disemicarbazide, etc.

(11) The treatment method for making a heat exchanger hydrophilic according to any of the aforementioned (8)~(10), wherein said treatment agent for hydrophilicity contains an antimicrobial drug.

The aforementioned treatment agent for hydrophilicity can be added with an antimicrobial drug besides deodorizer. Antimicrobial drugs usable in this invention can be exemplified by, for example, zink pyrithione, 2-(4-thiazoryl)-benzimidazole, 1,2-benzisothiazoline, 2-n-octyl-4-isothiazoline-3-on, N-(fluorodichloromethylthio) phthalimide, N,N-dimethyl-N'-phenole-N'-fluorodichloromethylthio)-sulfamide, methyl 2-benzimidazolecarbamate, bis(dimethylthiocarbamoyl)-disulfide,N-(trichloromethylthio)-4-cyclohexane-1,2-dicrboxyimide, and barium metaborate. These antimicrobial drugs can be used as the antifungal substance, antiseptic and antibacterial drug. Antimicrobial drugs can manifest their effects by adding them at the concentration higher than 10 ppm relative to the treatment agent for hydrophilicity.

(12) The treatment method for making a heat exchanger hydrophilic according to any of the aforementioned (8)~(11), wherein said heat exchanger is a car evaporator.

Herein, the following things are also included in this invention.

(13) A heat exchanger treated for making it hydrophilic by the treatment method for making a heat exchanger hydrophilic according to any of the aforementioned (8)~(12).

Another aspect of this invention may be described as follows.

(14) A pickling agent for a heat exchanger, which is used to perform a cleaning treatment to a heat exchanger made of aluminum materials prior to the performance of a chemical transformation treatment, containing at least one acid selected from a group comprising nitric acid, sulfuric acid and hydrofluoric acid.

(15) The pickling agent according to the aforementioned (14) which contains iron salt.

(16) The pickling agent according to the aforementioned (15), wherein said iron salt is iron sulfate, iron nitrate, iron acetate, or iron chloride.

(17) The pickling agent according to the aforementioned (15) or (16), wherein the content of said iron salt is in the range 0.01~5 weight percent.

DETAILED DESCRIPTION OF THE PREFERRED EMBODIMENTS

The treatment method for hydrophilicity of this invention will be described below in detail.

<Cleaning Treatment>

First, the cleaning treatment for heat exchanger is performed using a pickling agent. For cleaning a heat exchanger, it is sprayed with said cleaner, or soaked into a bath containing said cleaner. After the cleaning, the evaporator is washed with water, and then subjected to the chemical transformation treatment.

<Chemical Transformation Treatment>

There is no particular limitation to this treatment, which can be performed, for example, by the immersion method, spraying method. etc. However, in the case of the chemical transformation treatment for a heat exchanger having a complex shape such car evaporator, etc., it is preferable to use the immersion method.

Treatment temperature is preferably the room temperature or slightly warmer temperature than that, in the range 10~70° C., and the treatment time is preferably 3 s~5 min. Amount of the chemical conversion coating film is preferably 10~300 mg/m$^2$ as the amount of each element (Cr, Zr) adhered to the metal surface.

When the amount of said chemical conversion coating film is less than 10 mg/m$^2$, the anti-rust capability is often insufficient, and when it exceeds 300 mg/m$^2$, it becomes uneconomical. After the chemical transformation treatment, washing with water is performed as the occasion demands, prior to the subsequent treatment for making it hydrophilic.

In addition, like the aforementioned treatment agent of zirconium series, titanium salts including titanium fluoride can be used as the non-chromium chemical transformation treatment agent. And, as an anti-rust treatment as effective as the chemical transformation treatment, the undercoating as the anti-rust treatment with resin primers may be performed. By performing the undercoating as the anti-rust treatment with said resin primers, the undercoating film by resin is formed on the surface of heat exchanger.

The aforementioned resin primer can be exemplified by water-soluble or water-dispersible aqueous resin, specifically, aqueous polymer compounds having carboxyl group or hydroxyl group such as poly (meta) acrylic acid, polyvinyl alcohol, carboxymethyl cellulose, etc., aqueous phenolic resin, aqueous polyester resin, aqueous epoxy resin, aqueous polyurethane, aqueous amino resin, etc.

Corrosion resistance of coating film can be improved by supplementing the aforementioned resin primers with metallic compounds such as zirconium compounds, etc. including fluorozirconic acid, fluorozirconium ammonium, etc. at the concentration of 100~10000 ppm.

After similarly treated as chemical conversion coating film, it is preferable to bake resin primers at 100~220° C., preferably at 150~200° C. for 10~60 min to make the dried coating film 0.1~10 $\mu$m thick. When the baking temperature of resin primer is less than 100° C., the film formation becomes insufficient, and when said temperature exceeds 220° C., the lasting hydrophylicity is reduced. When the resin primer coating film is less than 0.1 $\mu$m thick, the rust preventive capacity is often insufficient, and when said film exceeds 10 $\mu$m thick, it becomes uneconomical.

<Treatment for Hydrophylicity>

To prepare a treatment agent for hydrophilicity used in this invention, first, polymer of vinyl alcohol series (and other hydrophilic polymer, when the occasion demands. Hereafter simply referred to as polymer of vinyl alcohol series.) is dissolved or dispersed to make the concentration 0.3~17.5 weight percent, preferably 0.5~5 weight percent relative to the entire treatment agent. To this mixture were added silica particulates of 5~100 nm, preferably 7~60 nm in the average particle diameter to the final concentration 0.3~17.5 weight percent, preferably 0.5~5 weight percent relative to the entire treatment agent.

Alternatively, by dispersing silica particulates in an aqueous solution of polymer of vinyl alcohol series containing 5~50 weight percent relative to silica particulates as its solid, said silica particulates are previously coated with polymer of vinyl alcohol series, and then the concentration may be adjusted by adding an aqueous solution of polymer of vinyl alcohol series.

When polymer of vinyl alcohol series is mixed with silica particulates as described above, aggregation occurs by the interaction between them. Therefore, these aggregates are forcibly dispersed using ultrasonic disintegrator or micro-medium disperser, etc.

Since disperser such as mixer used for simple stirring and dispersion cannot disperse aggregates, it is necessary to use a device having the grinding function like a mill or vigorous stirring effects on minute parts like the ultrasonic wave. As examples for such disperser, there are an ultrasonic homogenizer (US series) from Nippon Seiki Seisakusho, and a super mill (HM-15) of Inoue Seisakusho. Aggregates thus forcibly dispersed become particles of 5~1000 nm in the average particle diameter comprising silica particulates the surface of which is coated with polymer of vinyl alcohol series, and stabilized as dispersion in aqueous medium.

In the aforementioned treatment agents for hydrophilicity, various additives can be supplemented besides the aforementioned deodorizer and antimicrobial drugs as the occasion demands. These additives can be exemplified by lubricant, surfactant, pigment, dye and inhibitor to prevent corrosion.

In this invention, the treatment for hydrophilicity is performed using the treatment agent for hydrophilicity thus prepared as described above. There is no particular limitation in the treatment method, and treatment can be carried out, for example, by immersion method, spraying method, etc. However, in the case of the treatment for a heat exchanger having a complex shape such a car evaporator, etc., it is preferable to use the immersion method. Preferable temperature of the treatment liquid is around 10~50° C., and treatment time is 3 s~5 min.

After the treatment for hydrophilicity, the hydrophilic coating film can be obtained by baking the treated surface at 100~220° C., preferably 150~200° C. for 10~60 min. When the baking temperature is less than 100° C., film formation becomes insufficient, and, on the other hand, when it exceeds 220° C., the lasting hydrophylicity is reduced.

Heat exchanger treated for hydrophilicy of this invention (heat exchanger made hydrophilic) is manufactured by the aforementioned method, and a chemical conversion coating film is formed on the surface of aluminum material which has been treated by the acid washing with a pickling agent, furthermore, on said surface, the hydrophilic coating film is formed in amount of 0.1~3 g/m$^2$. This hydrophilic coating film is formed from a treatment agent for hydrophilicity containing silica particulates coated with a polymer of vinyl alcohol series.

EXAMPLES

Next, the present invention will be described in more detail with reference to examples and comparative examples. In examples and comparative examples of this invention, a car evaporator has been selected as the heat exchanger which is subjected to the treatment for hydrophylicity.

Example 1

Pickling agent containing 10 weight percent (2.3 N) nitric acid was used. A car evaporator was immersed in a bath containing this cleaner pre-warmed to 65° C. for 4 min, and thoroughly washed with tap water after taken up from the bath. Further, this car evaporator was immersed in a bath of chromium chromate (Alsurf 600LN2, Nippon Paint Co., Ltd.) pre-warmed to 50° C. for 90 s, and then thoroughly washed with tap water.

Then, this car evaporator thus treated was immersed into a bath of the following treatment agent for hydrophilicity at 20° C. for 1 min, taken up, and heat dried at the reached temperature 180° C. for 5 min to complete the evaporator treated for hydrophilicity with the coating film in the amount of 1 g/m$^2$. Type of the pickling agent and chemical transformation agent, and the composition of treatment agent for hydrophilicity are shown in Table 1.

<Preparation of Treatment Agent for Hydrophilicity>

To an aqueous solution of 25 weight parts of polyvinyl alcohol powder (saponification level 98% or more) dissolved in 950 weight parts of pure water was added 25 weight parts of humed silica (average particle diameter 40 nm), and the resulting mixture was stirred to form aggregates. Aggregates were then forced to disperse using an ultrasonic disperser (ultrasonic homogenizer, Nihon Seiki) to obtain silica particulates coated with polyvinyl alcohol of the average particle diameter 500 nm dispersed in water. Furthermore, to the resulting dispersion in aqueous medium, zinc pyrithione as the antimicrobial agent was added to make a final concentration of 100 ppm to obtain the treatment agent for hydrophilicity. In this case, the average particle diameter was measured on a portion of said treatment agent for hydrophilicity thus obtained which was diluted with deionized water using a dynamic light scattering measuring instrument (Ohtsuka Electronic).

The aforementioned evaporator which was made hydrophilic was assessed for its lasting hydrophylicity, deodorizing property and corrosion resistance according to the following methods, and the results are shown in Table 2.

[Assessment]

<Lasting Hydrophilicity>

Evaporator made hydrophilic was immersed in water, and, 500 h later, the contact angle with water was measured. Contact angle less than 30° indicates the maintenance of hydrophilicity, and that less than 20° is assessed as excellent.

<Odor>

Evaporator made hydrophilic was immersed in water, and, 500 h later, it was smelled and assessed on the following five stage scale:

| | |
|---|---|
| 0 point . . . | no smell |
| 1 point . . . | barely, faint smell |
| 2 points . . . | easily detectable smell |
| 3 points . . . | obvious smell |
| 4 points . . . | strong smell |
| 5 points . . . | very strong smell |

<Corrosion Resistance>

Evaporator made hydrophilic was subjected to a 5% salt water spray test (240 h) according to the JIS Z 2371 to calculate the white rust formation rate. In this case, the white rust formation rate was roughly calculated based on the observation of white rust formation on the car evaporator surface with the naked eye.

Examples 2~7 and Comparative Example 1~5

Except for alterations of pickling agent, chemical transformation agent and treatment agent for hydrophilicity to the recipes shown in Table 1, evaporator made hydrophilic was obtained according to the similar method as described in example 1. These assessment results are shown in Table 2.

TABLE 1

| | Pickling agent | Chemical trans-formation agent | Treatment agent for hydrophilicity: Amount | PVA content | Anti-microbial drug |
|---|---|---|---|---|---|
| Example 1 | Containing 10% nitric acid | Chromium chromate | 2.5% | 2.5% | + |
| Example 2 | 10% Nitric acid + 5% sulfuric acid | Chromium chromate | 2.5% | 2.5% | + |
| Example 3 | 10% Nitric acid + 5% sulfuric acid | Chromium phosphate | 2.5% | 2.5% | + |
| Example 4 | 10% Nitric acid + 5% sulfuric acid | Chromium phosphate | 2.0% | 2.5% | + |
| Example 5 | 10% Nitric acid + 5% sulfuric acid | Chromium phosphate | 2.5% | 2.0% | + |
| Example 6 | 10% Nitric acid + 5% sulfuric acid + 1% iron | Chromium phosphate | 2.5% | 2.5% | + |
| Example 7 | 10% Nitric acid + 5% sulfuric acid | Chromium phosphate | 2.5% | 2.5% | – |
| Comparative example 1 | No acidic washing | Chromium phosphate | 2.5% | 2.5% | + |
| Comparative example 2 | 10% Nitric acid + 5% sulfuric acid | No chemical trans-formation | 2.5% | 2.5% | + |
| Comparative example 3 | 10% Nitric acid + 5% sulfuric acid | Chromium phosphate | 1.0% | 2.5% | + |
| Comparative example 4 | 10% Nitric acid + 5% sulfuric acid | Chromium phosphate | 2.5% | 1.0% | + |
| Comparative example 5 | 10% Nitric acid + 5% sulfuric acid | Chromium phosphate | 2.5% (no dis-persion) | 2.5% (no dis-persion) | + |

Chromium phosphate (Alsurf 470/47, Nippon Paint Co., Ltd.)
Chromium chromate (Alsurf 7600LN2, Nippon Paint Co., Ltd.)

TABLE 2

| | Lasting hydrophilicity | Odor | White rust formation rate |
|---|---|---|---|
| Example 1 | 20° | 1.5 points | 5% |
| Example 2 | 20° | 1.5 points | 5% |
| Example 3 | 20° | 1.5 points | 15% |
| Example 4 | 25° | 1.5 points | 15% |
| Example 5 | 17° | 1.5 points | 15% |
| Example 6 | 20° | 1.5 points | 10% |
| Example 7 | 20° | 3.0 points (mold smell) | 15% |
| Comparative example 1 | 20° | 3.0 points (dust/rust smell) | 50% |
| Comparative example 2 | 20° | 3.5 points (dust/rust smell) | 100% |
| Comparative example 3 | 20° | 1.5 points | 15% |
| Comparative example 4 | 15° | 3.0 points (dust smell) | 15% |
| Comparative example 5 | 45° | 1.5 points | 15% |

Corrosion resistance was measured by the JIS Z-2371 salt water spraying test, and results were expressed as the white rust formation rate 240 h later.

As clearly shown in Table 2, the evaporator treated for hydrophilicity obtained in the example of this invention was excellent in its lasting hydrophilicity, maintaining the contact angle with water around 200 even after 500 h. It smelled only faintly after immersed in water for 500 h.

Example 8, Comparative Example 6

In Example 8 and comparative example 6, effects of pickling agents containing iron salts were confirmed in the cases where non-chromium, zirconium series chemical transformation agents were subsequently used. Except that pickling agents, chemical transformation agents and treatment agents for hydrophilicity were altered to the recipes shown in Table 3, and that the chemical transformation treatment was performed under the conditions wherein a car evaporator was immersed in a treatment agent contgaining ziruconium ion at the concentration of 100 ppm prewarmed to 50° C. in a bath for 90 s, followed by thorough washing with tap water, experiment was carried out similarly as in example 1 to obtain an evaporator treatged for hydrophilicity. These assessment results are shown in Table 4.

TABLE 3

| | Pickling agent | Chemical trans-formation agent | Treatment agent for hydrophilicity Amount | PVA content | Anti-microbial drug |
|---|---|---|---|---|---|
| Example 8 | 10% Nitric acid + 5% sulfuric acid + 1% iron | Zirconium fluoride | 2.5% | 2.5% | + |
| Comparative example 6 | 10% Nitric acid + 5% sulfuric acid | Zirconium fluoride | 2.5% | 2.5% | + |

TABLE 4

| | Lasting hydrophilicity | Odor | White rust formation rate |
|---|---|---|---|
| Example 8 | 20° | 1.5 points | 10% |
| Comparative example 6 | 20° | 2.5 points (dust smell) | 20% |

Corrosion resistance was measured by the JIS Z-2371 salt water spraying test, and results were expressed as the white rust formation rate 240 h later.

As clearly understood from example 8 and comparative example 6, the use of a pickling agent containing iron salt prior to the application of a chemical transformation treatment agent, even though it contained no chromium, could suppress the white rust formation after a 240 h-salt water spraying, indicating an excellent corrosion resistance.

In the treatment method for hydrophilicity according to this invention, the acidic washing treatment is performed prior to the chemical transformation treatment, enabling a thorough cleaning of deposits from solders, and formation of strong as well as homogeneous chemical conversion coating film. Therefore, as a result, it becomes possible to greatly improve the corrosion resistance of heat exchanger, and at the same time prevent bad odor caused by white rust.

Furthermore, in the treatment method for hydrophilicity according to this invention, since a hydrophilic coating film is formed with a treatment agent for hydrophilicity containing silica particulates coated with polymer of vinyl alcohol series, hydrophilicity can be maintained by the surface irregularity of silica particulates. In addition, it is unlikely that coated silica particulates are directly exposed to the atmosphere, or washed out by the condensed water even with a slight deterioration of hydrophilic coating film after a long-time use. Therefore, the coating film is very high in its lasting hydrophilicity, and effective in preventing the generation of silica-specific dust smell and smell of bacteria adhering to silica.

What is claimed is:

1. A pickling method for a heat exchanger made of aluminum materials, wherein a cleaning treatment is performed by bringing said heat exchanger into contact with a pickling agent containing at least one acid selected from a group comprising nitric acid, sulfuric acid and hydrofluoric acid prior to the chemical transformation treatment applied to said heat exchanger;

wherein said pickling agent further contains an iron salt selected from a group consisting of iron sulfate, iron nitrate, iron acetate and iron chloride, the iron salt being in the range 0.01 to 5 weight percent; and wherein said cleaning treatment comprises bringing said heat exchanger into contact with said pickling agent under the conditions at 10° C. for 30 seconds to 5 minutes.

2. The pickling method according to claim 1, wherein said heat exchanger has brazed parts.

3. The pickling method according to claim 1, wherein said heat exchanger is a car evaporator.

4. A treatment method for making a heat exchanger hydrophilic comprising previously performing the pickling treatment for a heat exchanger by any of the following methods (1) to (4), and performing a chemical transformation treatment to form a chemical conversion coating film with a zirconium series treatment agent, followed by the treatment for making said heat exchanger hydrophilic using the following treatment agent for hydrophilicity, so that the amount of coating film becomes 0.1 to 3 g/m$^2$, wherein:

"treatment agent for hydrophilicity" means a treatment agent which contains silica particulates and polymers of vinyl alcohol series in the weight ratio in the range 30:70~70:30 in aqueous medium, amounting to 0.2~25 weight percent in total for both, in which said silica particulates are coated with said polymer of vinyl alcohol series, and dispersed in the aqueous medium as coated particles having the average particle diameter of 5 nm to 1000 nm, wherein said method comprises:

(1) a pickling method for a heat exchanger made of aluminum materials, wherein a cleaning treatment is performed by bringing said heat exchanger into contact with a pickling agent containing at least one acid selected from a group consisting of nitric acid, sulfuric acid and hydrofluoric acid, and iron salt prior to the chemical transformation treatment applied to said heat exchanger;

(2) the pickling method according to the aforementioned (1), wherein said iron salt is iron sulfate, iron nitrate, iron acetate or iron chloride;

(3) the pickling method according to the aforementioned (1) or (2), wherein said pickling agent contains an iron salt in the range 0.01 to 5 weight percent; and (4) the pickling method according to the aforementioned (3), wherein said cleaning treatment comprises bringing said heat exchanger into contact with said pickling agent under the conditions at 10 to 85° C. for 30 seconds to 5 min.

5. The treatment method for making a heat exchanger hydrophilic according to claim 4, wherein said treatment agent for hydrophilicity further contains a deodorizer comprising an organic material having amido and/or phenol groups.

6. The treatment method for making a heat exchanger hydrophilic according to claim 4, wherein said treatment agent for hydrophilicity further contains an antimicrobial drug.

7. The treatment method for making a heat exchanger hydrophilic according to any of claim 5, wherein said treatment agent for hydrophilicity contains an antimicrobial drug.

8. The treatment method for making a heat exchanger hydrophilic according to claim 4, wherein said heat exchanger is a car evaporator.

9. The treatment method for making a heat exchanger hydrophilic according to claim 5, wherein said heat exchanger is a car evaporator.

10. The treatment method for making a heat exchanger hydrophilic according to claim 7, wherein said heat exchanger is a car evaporator.

11. A treatment method for making a heat exchanger hydrophilic comprising the steps of:

brining a heat exchanger made of aluminum materials into contact with a pickling agent containing at least one acid selected from a group consisting of nitric acid, sulfuric acid and hydrofluoric acid so as to clean the heat exchanger;

performing a chemical transformation treatment to the heat exchanger for forming a chemical conversion coating film; and then applying a treatment agent for hydrophilicity onto the heat exchanger for producing a hydrophilic coating film thereon so as to make the heat exchanger for producing a hydrophilic coating film thereon so as to make the heat exchanger hydrophilic, the treatment agent for hydrophilicity containing silica particulates and a polymer of vinyl alcohol series in an aqueous medium, wherein the silica particulates are coated with the polymer of vinyl alcohol series and dispersed in the aqueous medium.

12. The treatment method of claim 11, wherein the treatment agent for hydrophilicity further contains a deodorizer comprising an organic material having at least one species selected from the group consisting of an amide group and a phenol group.

13. The treatment method for making a heat exchanger hydrophilic according to claim 11, wherein said treatment agent for hydrophilicity further contains an antimicrobial drug.

14. The treatment method for making a heat exchanger hydrophilic according to claim 12, wherein said treatment agent for hydrophilicity further contains an antimicrobial drug.

15. The treatment method for making a heat exchanger hydrophilic according to claim 11, wherein said heat exchanger is a car evaporator.

16. The treatment method for making a heat exchanger hydrophilic according to claim 12, wherein said heat exchanger is a car evaporator.

17. The treatment method for making a heat exchanger hydrophilic according to claim 14, wherein said heat exchanger is a car evaporator.

18. The treatment method of claim 11 wherein the treatment agent for hydrophilicity contains the silica particulates ranging from 30 to 70 parts by weight and the polymer of vinyl alcohol series ranging from 70 to 30 parts by weight.

19. The treatment method of claim 11 wherein the treatment agent for hydrophilicity contains 0.2 to 25 percent by weight of a sum of the silica particulates and the polymer of vinyl alcohol series.

20. The treatment method of claim 11 wherein the coated silica particulates have an average particle diameter of 5 nm to 1000 nm.

21. The treatment method of claim 11 wherein the hydrophilic coating film is formed in a range of 0.1 to 3 g/m2.

22. The treatment method of claim 11 wherein the chemical transformation treatment is carried out by a first agent containing chromium chromate, a second agent containing a chromium phosphate or a third agent containing a zirconium series compound.

23. The treatment method of claim 11 wherein the pickling agent further contains an iron salt.

24. The treatment method of claim 23 wherein the iron salt is iron sulfate, iron nitrate, iron acetate or iron chloride.

25. The treatment method of claim 11 wherein the pickling agent further contains an iron salt in the range of 0.01 to 5 percent by weight.

26. The treatment method of claim 11 wherein the brining step comprises brining the heat exchanger into contact with the pickling agent under conditions at a range of 10 to 85° C. for a period of 30 seconds to 5 minutes.

27. A hydrophilic heat exchanger made by a method comprising the steps of:

brining a heat exchanger made of aluminum materials into contact with a pickling agent containing at least one acid selected from a group consisting of nitric acid, sulfuric acid and hydrofluoric acid so as to clean the heat exchanger;

performing a chemical transformation treatment to the heat exchanger for forming a chemical conversion coating film; and then applying a treatment agent for hydrophilicity onto the heat exchanger for producing a hydrophilic coating film thereon so as to make the heat exchanger hydrophilic, the treatment agent for hydrophilicity containing silica particulates and a polymer of vinyl alcohol series in an aqueous medium wherein the silica particulates are coated with the polymer of vinyl alcohol series and dispersed in the aqueous medium;

wherein the hydrophilic heat exchanger has the hydrophilic coating film containing the polymer of vinyl alcohol serving as a medium and a plurality of the silica particulates dispersed in the medium.

28. The hydrophilic heat exchanger of claim 27 wherein the hydrophilic coating film contains the silica particulates ranging from 30 to 70 parts by weight and the polymer of vinyl alcohol series ranging from 70 to 30 parts by weight.

29. The hydrophilic heat exchanger of claim 27 wherein the treatment agent for hydrophilicity contains 0.2 to 25 percent by weight of a sum of the silica particulates and the polymer of vinyl alcohol series.

30. The hydrophilic heat exchanger of claim 27 wherein the coated silica particulates have an average particle diameter of 5 nm to 1000 nm.

31. The hydrophilic heat exchanger of claim 27 wherein the hydrophilic coating film is formed in a range of 0.1 to 3 g/m2.

32. The hydrophilic heat exchanger of claim 27 wherein the chemical transformation treatment is carried out by a first agent containing chromium chromate, a second agent containing a chromium phosphate or a third agent containing a ziconium series compound.

33. The hydrophilic heat exchanger of claim 27 wherein the pickling agent further contains an iron salt.

34. The hydrophilic heat exchanger of claim 27 wherein the iron salt is iron sulfate, iron nitrate, iron acetate or iron chloride.

35. The hydrophilic heat exchanger of claim 27 wherein the pickling agent further contains an iron salt in the range of 0.01 to 5 percent by weight.

36. The hydrophilic heat exchanger of claim 27 wherein the brining step comprises bringing the heat exchanger into contact with the pickling agent under conditions at a range of 10 to 85° C. for a period of 30 seconds to 5 minutes.

* * * * *

UNITED STATES PATENT AND TRADEMARK OFFICE

CERTIFICATE OF CORRECTION

PATENT NO. : 6,554,916 B2
APPLICATION NO. : 09/854147
DATED : April 29, 2003
INVENTOR(S) : Kojima et al.

It is certified that error appears in the above-identified patent and that said Letters Patent is hereby corrected as shown below:

Column 11, line 1, “200” should read --20°--.

Claim 1, in column 12, line 19, “10° C.” should read --10°C to 85°C--.

Signed and Sealed this

Ninth Day of December, 2008

JON W. DUDAS
*Director of the United States Patent and Trademark Office*